United States Patent [19]

Bland

[11] 4,218,955

[45] Aug. 26, 1980

[54] PRESSURE ACTUATED SHIFTING MECHANISM

[75] Inventor: Gerald F. Bland, Kenosha, Wis.

[73] Assignee: Outboard Marine Corporation, Waukegan, Ill.

[21] Appl. No.: 2,377

[22] Filed: Jan. 10, 1979

[51] Int. Cl.[2] ..... F15B 13/02

[52] U.S. Cl. ..... 91/47; 91/417 R; 60/403; 440/75; 74/843; 60/484

[58] Field of Search ..... 91/47, 356, 417 R, 508, 91/518; 74/843; 115/34 R, 34 A; 60/403, 484

[56] References Cited

U.S. PATENT DOCUMENTS

| | | | |
|---|---|---|---|
| 2,770,222 | 11/1956 | Anderson | 91/356 |
| 2,854,957 | 10/1958 | Svingor et al. | 91/379 |
| 2,991,758 | 7/1961 | Pfau | 91/417 R |
| 3,033,170 | 5/1962 | Norton et al. | 91/417 R X |
| 3,863,547 | 2/1975 | Meier et al. | 91/416 |
| 4,051,766 | 10/1977 | Strauff | 91/417 R |

*Primary Examiner*—Edgar W. Geoghegan
*Attorney, Agent, or Firm*—Michael, Best & Friedrich

[57] ABSTRACT

An apparatus for delivering power to a marine propulsion device comprises an engine, a propeller, and a transmission which operatively connects the engine with the propeller and which is operative between a neutral position and a drive position. The apparatus further includes a source of pressurized fluid, a cylinder and a differential piston movable within the cylinder in response to pressurized fluid. A first conduit continuously conducts pressurized fluid from the source to the cylinder to locate the piston in a first position in the cylinder, and a second conduit conducts pressurized fluid from the source to the cylinder to locate the piston in a second position in the cylinder which second position is spaced from the first position. A flow control device communicates with the second conduit for selectively permitting the flow of pressurized fluid through the second conduit to displace the piston from the first position to the second position. The piston is operatively connected with the transmission so that the transmission is located in the neutral position when the piston is located in the first position and is located in the drive position when the piston is located in the second position.

11 Claims, 4 Drawing Figures

PRESSURE ACTUATED SHIFTING MECHANISM

BACKGROUND OF THE INVENTION

I. Field of the Invention

The invention relates generally to marine propulsion devices, and more particularly, to shifting mechanisms for marine propulsion devices. Still more particularly, the invention relates to shifting mechanisms for marine propulsion devices, which mechanisms are actuated by fluid pressure.

II. Description of the Prior Art

Attention is directed to the pressure actuated devices which are disclosed in the following U.S. Pat. Nos,:

| | | |
|---|---|---|
| Anderson | 2,770,222 | Nov. 13, 1956 |
| Svingoretal | 2,854,957 | Oct. 7, 1958 |
| Pfau | 2,991,758 | Jul. 11, 1961 |
| Nortonetal | 3,033,170 | May 8, 1962 |
| Meier | 3,863,547 | Feb. 4, 1975 |
| Strauff | 4,051,766 | Oct. 4, 1977 |

None of the above cited prior art discloses a pressure actuated shifting mechanism which is operatively connected with a transmission and which, in the absence of operator involvement, normally maintains the transmission in the neutral or out-of-gear position. Furthermore, none of the above cited prior art discloses a pressure actuated shifting mechanism which permits shifting of the transmission from its neutral position to its drive or in-gear position only when a sufficient range of operational pressures is present, and to automatically return the transmission to its neutral position whenever existing pressure drops below the sufficient range of pressures. Lastly, none of the above cited prior art discloses a pressure actuated shifting mechanism which protects the shifting mechanism from damage or failure due to pressure in excess of the sufficient range of pressures.

SUMMARY OF THE INVENTION

The invention provides an apparatus for delivering power to a marine propulsion device which comprises an engine, a propeller, and transmission means for operatively connecting the engine with the propeller. The transmission means is movable between a neutral position in which the engine is operatively disconnected from the propeller and a drive position in which the engine powers the propeller. The apparatus further includes a source of pressurized fluid, a cylinder having opposed first and second ends, and a piston movable in the cylinder between the first and second ends. A piston rod extends from the piston through the first end of the cylinder. First conduit means conducts pressurized fluid from the source to adjacent to the first end to displace the piston toward the second end, and second conduit means conducts pressurized fluid from the source to adjacent to the second end to displace the piston toward the first end. The second conduit means includes flow control means for selectively permitting the flow of pressurized fluid to adjacent to the second end. Means connects the piston rod to the transmission means for locating the transmission means in the neutral position when the piston is located adjacent to the second end and for locating the transmission means in the drive position when the piston is located adjacent to the first end.

In accordance with one embodiment of the invention, the source includes a sump and pump means having a suction side communicating with the sump and an outlet side communicating with the first and second conduit means. The pump means is operative for pumping fluid from the sump through the first and second conduit means subject to a pressure varying between a low magnitude of pressure, a high magnitude of pressure, and an intermediate range of pressures between the low and high magnitudes of pressure. In this emobodiment, the second conduit means further includes flow regulation means independent of the flow control means for permitting the flow of pressurized fluid through the second conduit means when the magnitude of pressure falls within the intermediate range of pressures and for preventing the flow of pressurized fluid through the second conduit means when the magnitude of pressure is below the intermediate range of pressure, notwithstanding the operation of the flow control means. Also, in this embodiment, the first and second conduit means include pressure relief means for relieving pressure in the respective conduit means when the magnitude of pressure is above the intermediate range of pressures.

In accordance with one embodiment of the invention, the flow control means includes a control valve operative between a first position blocking the flow of pressurized fluid from the source to adjacent to the second end and a second position directing the flow of pressurized fluid from the source to adjacent to the second end.

In one embodiment, the apparatus further includes a main supply passageway having an inlet end communicating with the outlet side of the pump means and a discharge passageway venting the main supply passageway to the sump subject to action of the pressure relief means. The first and second conduit means communicate with the main supply passageway intermediate the inlet end and the discharge passageway. In this embodiment, the flow regulation means and the pressure relief means include a valve member movable in the main supply passageway, and a biasing spring normally biasing the valve member in the main supply passageway toward a position closing the second conduit and the discharge passageway from the main supply passageway, while affording communication between the main supply passageway and the first conduit means. The valve member is displaced in response to the intermediate range of pressures against the action of the biasing spring to a position in the main supply passageway affording communication of the main supply passageway with both the first and second conduit means, and is further displaced in response to the high magnitude of pressure against the action of the biasing spring to a position in the main supply passageway affording communication of the main supply passageway with the first and second conduit means and the discharge passageway. By virtue of this construction, operation of the transmission means from the neutral position to the drive position is prevented when the low magnitude of pressure is present, notwithstanding the disposition of the flow control valve, and, when the high magnitude of pressure is present, the first and second conduit means are vented to the sump so as to relieve the portion of the pressure which is in excess of the intermediate range of pressures.

In accordance with one embodiment of the invention, the engine powers the propeller for forward drive when the transmission means is in said drive position, and the transmission means further includes a second drive position in which the engine powers the propeller for reverse drive. In this embodiment, the apparatus further includes a second cylinder in addition to the first mentioned cylinder, the second cylinder including first and second ends, and a second piston in addition to the first mentioned piston movable between the first and second ends of the cylinder. A second piston rod extends from the second piston through the first end of the second cylinder. The first conduit means conducts pressure from the source to adjacent to each of the first ends to displace each of the first and second pistons toward the respective second end, and the second conduit means includes first and second branches communicating respectively adjacent to the second end of the first cylinder and adjacent to the second end of said second cylinder. The flow control means communicates with the first and second branches for selectively permitting the flow of pressurized fluid to adjacent to either the second end of the first cylinder or the second end of the second cylinder. In this embodiment, means connects the first and second piston rods with the transmission means for locating the transmission means in the neutral position when the first and second pistons are simultaneously located adjacent to their respective second ends, for locating the transmission means in the first mentioned drive position when the first piston is located adjacent to its respective first end when the second piston is located adjacent to its respective second end, and for disposing the transmission means in the second drive position when the second piston is located adjacent to its respective first end when the first piston is located adjacent to its respective second end.

In accordance with one embodiment of the invention the flow control means includes a control valve operative between a first position blocking the flow of pressurized fluid from the source to adjacent to the second ends of the first and second cylinders, a second position directing the flow of pressurized fluid from the source to adjacent to the second end of the first cylinder, and a third position directing the flow of pressurized fluid from the source to adjacent to the second end of the second cylinder.

One of the principal features of the invention is the provision of a pressure actuated shifting device which, in the absence of operator involvement, normally maintains the transmission in the neutral or out-of-gear position, and which shifts the transmission from the neutral position to the in-gear position in response to the operation of a flow control device by the operator.

Another of the principal features of the invention is the provision of a pressure actuated shifting device which permits shifting of the transmission from its neutral position to its in-gear position when a sufficient range of operational pressures is present, and which automatically returns the transmission to the neutral position whenever existing pressure drops below the sufficient range of pressures.

Yet another of the principal features of the is the provision of a pressure actuated shifting device which protects the shifting mechanism from damage or failure due to pressure in excess of the sufficient pressure level.

Still another of the principal features of the invention is the provision of a pressure actuated shifting device which includes two distinct and separately operable pistons, which thereby permits shifting of a transmission having a neutral position, a first or forward drive position and a second or reverse drive position.

Other features and advantages of the embodiments of the invention will become known by reference to the following general description, claims, and drawings.

Figure 1:
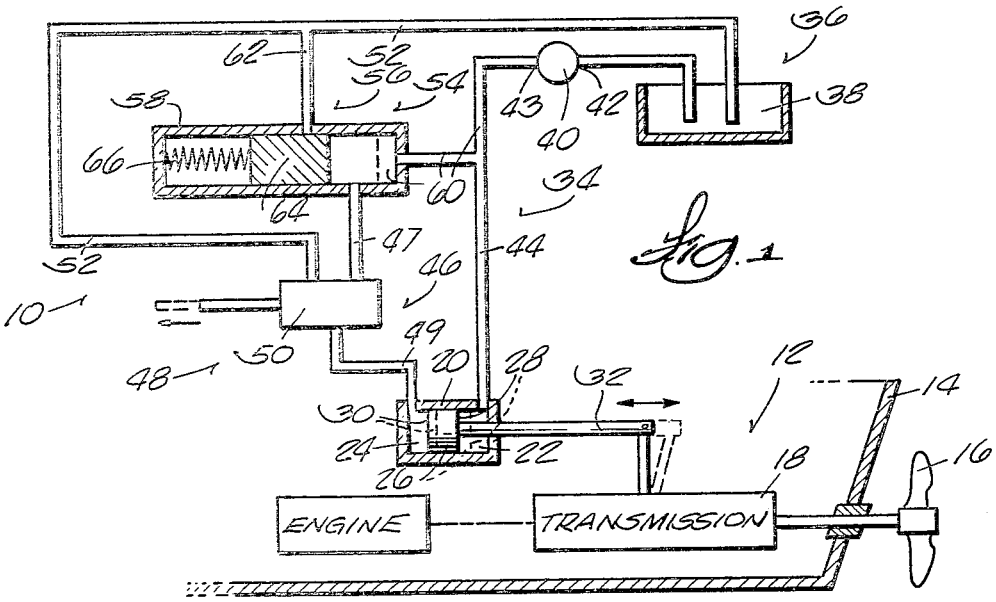
FIG. 1 is a diagrammatic view of a pressure actuated shifting apparatus for a marine propulsion device, which shifting apparatus embodies various of the features of the invention.

Before explaining the embodiments of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology used herein for the purpose of description should not be regarded as limiting.

GENERAL DESCRIPTION

Shown in FIG. 1 is a pressure actuated device 10 which embodies various of the features of the invention. While the device 10 is applicable for use in various environments, in the illustrated embodiment, the device 10 is used as a shifting mechanism for a marine propulsion device 12 which includes an inboard engine which is mounted on a boat 14 and is operatively connected by a transmission with a propeller 16. It should be appreciated that other marine propulsion devices 12 could be used, such as a stern drive unit or an outboard engine, and the pressure actuated shifting mechanism 10 would be equally as applicable.

While the transmission can be variously constructed, in the illustrated embodiment, a conventional transmission mechanism 18 having a plurality of intermeshing gears (not shown) is provided. The transmission mechanism 18 is operable between a neutral position (shown in solid lines in FIG. 1) in which the engine is operatively disconnected from the propeller 16 and a drive position (shown in phantom lines in FIG. 1) in which the engine powers the propeller 16, thereby driving the boat 14 through the water.

The pressure actuated shifting mechanism 10 selectively moves the transmission mechanism 18 between its neutral position and its drive position. More particularly, a cylinder 20 has diametrically opposed first and second ends 22 and 24, and a piston 26 is mounted for movement within the cylinder 20 between the first and second ends 22 and 24. The piston 26 includes a first face 28 communicating with the first end 22 and a second face 30 communicating with the second end 24. A connecting rod 32 is suitably fastened to the first piston face 28 and extends through the first end 22 to operatively couple the piston 26 with the transmission mechanism 18. By virtue of the connecting rod 32, the effective area of the first piston face 28 is less than the effective area of the second piston face 30.

Conduit means 34 conducts pressure from a source 36 to each of the first and second chambers 22 and 24. The source 36 includes a sump 38 containing a suitable compressible medium, such as hydraulic fluid, and a pump 40 having a suction side 42 communicating with the sump 38 and a pressure head side 43 communicating with the conduit means 34. Operation of the pump 40 delivers fluid from the sump 38 through the conduit means 34 and, ultimately, to the first and second chambers 22 and 24 subject to a pressure varying between a low magnitude of pressure, a high magnitude of pressure, and an intermediate range of pressures between the low and high magnitudes of pressure.

More particularly, the conduit means 34 includes a first conduit 44 which conducts pressurized fluid from the pressure head side 43 of the pump 40 to adjacent to the first end 22 of the cylinder 20, and a second conduit 46 which conducts pressurized fluid from the pressure head side 43 of the pump 40 to adjacent to the second end 24 of the cylinder 20. As can be seen in FIG. 1, pressurized fluid is permitted to pass continuously through the first conduct 44, while the second conduit 46 includes flow control means 48 for controlling the passage of pressurized fluid through the second conduit 46. By virtue of the flow control means 48, the second conduit 46 is divided into an upper section 47 and a lower secton 49.

While the flow control means 48 may be variously constructed, in the illustrated embodiment, a shuttle valve 50 of conventional construction (not shown) is provided having a first position (shown in solid lines in FIG. 1) which blocks the upper section 47 of the second conduit 46 from communicating with the lower section 49 and vents the lower section 49 to the sump 38 through a suitable conduit 52. The flow of pressurized fluid to the second end 24 is thus blocked and any pressurized fluid then existent in the second end 24 is permitted to escape to sump 38 through lower section 49 and conduit 52. The shuttle valve 50 is movable, preferably by the operator, from the first position to a second position (as indicated by the arrow and phantom lines in FIG. 1) which blocks conduit 52 from communicating with both the upper and lower sections 47 and 49 and directs the flow of pressurized fluid from the upper section 47 to the lower section 49 and thus to the second end 24.

When the shuttle valve 50 is disposed in the first position, the continuous flow of pressurized fluid passing through the first conduit 44 reacts against the first piston face 28 and, in the absence of pressurized fluid reacting against the second piston face 30, displaces the piston 26 toward the second end 24 (or to the left, as is shown in FIG. 1). As is shown in solid lines in FIG. 1, displacement of the piston 26 adjacent to the second end 24 is such that it disposes the transmission mechanism 18 in its neutral position.

When the shuttle valve 50 is subsequently moved from the first position to the second position, pressurized fluid is permitted to pass through the second conduit 46, thereby reacting against the second piston face 30. Because the effective area of the second piston face 30 is larger than the effective area of the first piston face 28, the action of pressurized fluid against the second piston face 30 will displace the piston 26 toward the first end 22 (or, as is shown in FIG. 1, to the right) against the continuous action of pressurized fluid against the first piston face 28. As shown in phantom lines in FIG. 1, displacement of the piston 26 adjacent to the first end 22 disposes the transmission mechanism 18 in its drive position.

Subsequent movement of the shuttle valve 50 from the second position back to the first position will again block the upper end 47 of the second conduit 46 and vent the lower end 49 with the sump 38, thereby permitting the continuous flow of pressurized fluid through the first conduit 44 to again displace the piston 26 back toward the second end 24 (that is, back to the left, as is shown in FIG. 1), and the transmission mechanism 18 is thereby returned from its drive position back to its neutral position.

As should be apparent, operation of the shuttle valve 50 by the operator shifts the transmission mechanism 18 between the neutral position and the drive position. Also as should be apparent, by virtue of the continuous flow of pressurized fluid through the first conduit 44, the transmission mechanism 18 is, in effect, biased toward its neutral position and is shifted from its neutral position to its drive position only when pressurized fluid is directed through the second conduit 46 (as controlled by the operation of the shuttle valve 50) to overcome the biasing flow of pressurized fluid in the first chamber 22.

As heretofore, described, the shuttle valve 50 is movable linearly between its first and second positions. It is to be appreciated, however, that a shuttle valve of different conventional construction can be used, which shuttle valve is rotatably movable between corresponding first and second positions. In order to operate the shifting mechanism 10 within the intermediate range of pressures and thus prevent unreliable shifting operation as well as mechanical damage that can be caused by the low and high magnitudes of pressure, the second conduit 46 includes flow regulation means 54 which operates independently of the flow control shuttle valve 50 to permit operation of the transmission mechanism 18 between its neutral position and its drive position when the intermediate range of operational pressures is present, while preventing such operation when pressure below the intermediate range of pressures occurs. In addition, the first conduit 44 and second conduit 46 both include pressure relief means 56 which relieves the high magnitude of pressure in the respective first or second conduits 44 or 46 should such pressure in excess of the intermedidate range of pressures occur.

While the construction of the flow regulation means 54 and the pressure relief means 56 may vary, and appreciating that separate valve members could be used to individually perform the flow regulation and pressure relief functions, in the illustrative embodiment (see FIGS. 1 and 2), a primary control valve 58 performs both flow regulation and pressure relief functions.

Figure 2:
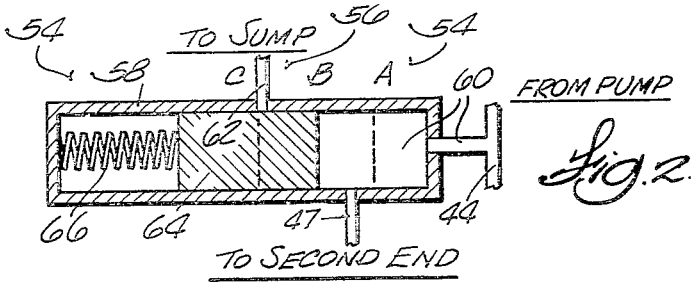
FIG. 2 is a diagrammatic exploded view of a primary control valve incorporated in the shifting apparatus shown in FIG. 1.

More particularly, and referring first to FIG. 1, a main supply passageway 60 communicates with the pressure head side 43 of the pump 40, and a discharge passageway 62 vents the main supply passageway 60 through the conduit 52 to the sump 38 subject to the action of the pressure relief means 56, as will soon be described. As shown in FIGS. 1 and 2, the upper section 47 of the second conduit 46 communicates with the main supply passageway 60 intermediate the discharge passageway 62 and the pressure head side 43 of the pump 40, and the first conduit 44 communicates with the main supply passageway 60 ahead of the communication of the main supply passageway 60 with the primary control valve 58.

Referring now to FIG. 2, the primary control valve 58 includes a member 64 which is movable within the main supply passageway 60 in the area where the discharge passageway 62 and the upper section 47 of the second conduit 46 intersect or communicate with the main supply passageway 60. The member 64 is biased by a spring 66 toward a first position (shown as position A in FIG. 2 and in phantom lines in FIG. 1), in which the member 64 blocks both the discharge passageway 62 and the upper section 47 of the second conduit 46, but not the first conduit 44, from the flow of pressurized fluid through the main supply passageway 60. The biasing force of the spring 66 is such that the member 64 is disposed in the first position whenever the low magnitude of pressure is present in the main supply passageway 60. Thus, when this low pressure situation occurs, pressurized fluid is permitted to flow only through the first conduit 44, thereby locating the transmission mechanism 18 in the neutral position, and operation of the shuttle valve 50 will be ineffective to shift the transmission mechanism 18 out of the neutral position into the drive position.

When the pressurized fluid in the main supply passageway 60 falls within the intermediate range of pressures, the force of the spring 66 is partially overcome, such that the member 64 is displaced from the first position (position A in FIG. 2) to a second position (shown as position B in FIG. 2 and in solid lines in FIGS. 1 and 2). In the second position, the member 64 affords communication between the main supply passageway 60, the first conduit 44, and the upper section 47 of the second conduit 46, but not with the discharge passageway 62. Thus, when the intermediate range of pressures occurs, pressurized fluid is permitted to flow through both the first conduit 44 and the upper section 47 of the second conduit 46, and operation of the shuttle valve 50 will selectively shift the transmission mechanism 18 between its neutral position and its drive position, as heretofore described.

When the pressurized fluid in the main supply passageway 60 exceeds the intermediate range of pressures, the force of the spring 66 is fully overcome such that the member 64 is displaced from the second position (position B in FIG. 2) to a third position (shown as position C in FIG. 2). In the third position, the member 64 affords communication between the main supply passageway 60, the first conduit 44, the upper section 47 of the second conduit 46, and discharge passageway 62. The high magnitude of pressure existent at this time is thus vented through the discharge passageway 62 and conduit 52 to the sump 38, until such time that the pressurized fluid falls back to within the intermediate range of pressures, and the spring 66 thereby urges the member 64 back from the third position (position C in FIG. 2) to the second position (position B in FIG. 2). Thus, when this high pressure situation occurs, the shifting mechanism 10 is protected from damage.

As should now be apparent, the primary control valve 58 permits shifting of the transmission mechanism 18 between the neutral position and the drive position when the intermediate range of pressures is present, and should the magnitude of pressure drop below the intermediate range of pressures, the transmission mechanism 18 is automatically returned from the drive position back to the neutral position and the shuttle valve 50 is rendered inoperative to permit operation of transmission mechanism. Furthermore, should the magnitude of pressure exceed the intermediate range of pressures, the high magnitude of pressure in excess of the intermediate range of pressures is vented to the sump 38, thereby preventing overpressure damage to the shifting mechanism 10.

Figure 3:
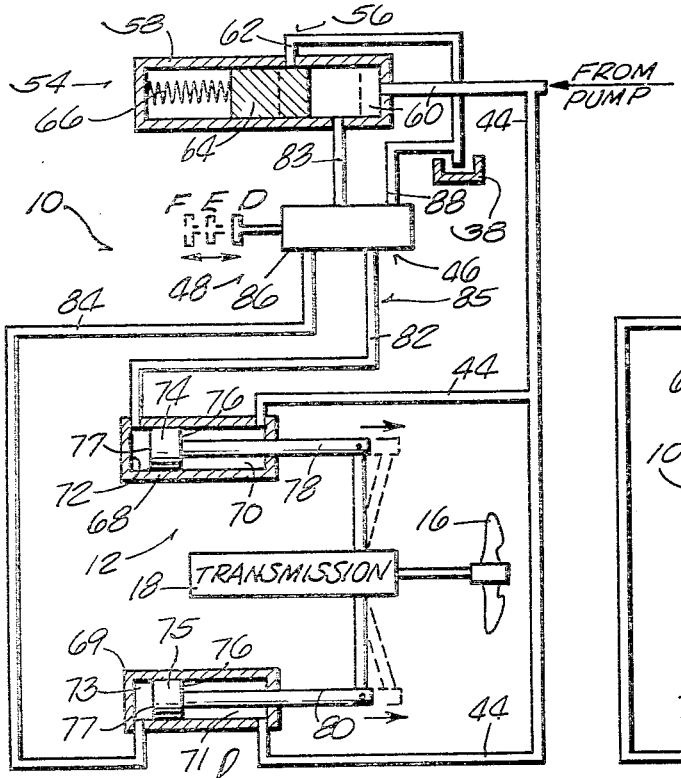
FIG. 3 is a diagrammatic view of another embodiment of a pressure actuated shifting apparatus for a marine propulsion device in which the transmission is disposed in the neutral position.
Figure 4:
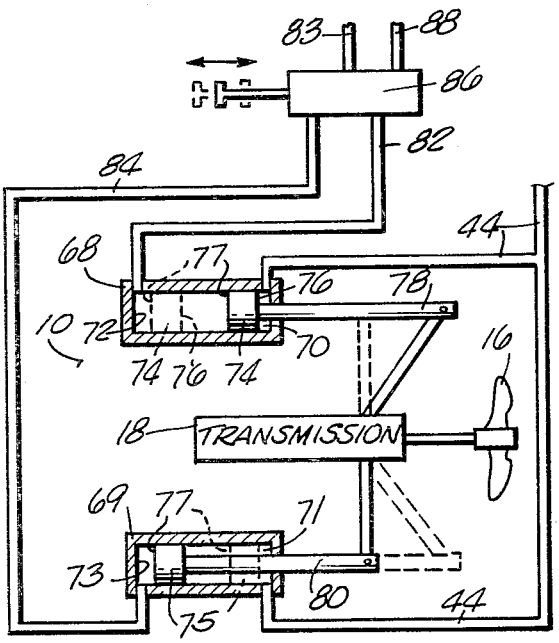
FIG. 4 is a diagrammatic exploded view of a portion of the shifting apparatus shown in FIG. 3 in which the transmission is disposed in the first drive position.

Another embodiment of the invention is shown in FIGS. 3 and 4, which embodiment is, in many respects, similar to the one shown in FIGS. 1 and 2. Components common to both embodiments are assigned the same reference numbers. As in the first embodiment, the pressure actuated shifting mechanism 10 is biased by pressurized fluid continuously passing through the first conduit 44 so as to locate the transmission mechanism 18 toward the neutral position, and the flow control means 48 communicates with the second conduit 46 so as to selectively operate the transmission mechanism 18 between its neutral position and its in-drive position. Also as in the first embodiment, the primary control valve 58 includes a member 64 which is operative between three positions as heretofore described to prevent the shifting of the transmission mechanism 18 from its neutral position to its in-drive position whenever pressurized fluid below the intermediate range of pressures is present and to vent the first conduit 44 and the second conduit 46 to the sump 38 when pressurized fluid above the intermediate range of pressures is present. As is shown in solid lines in FIG. 3, the member 64 is positioned as it would be when the intermediate range of pressures is present, affording communication between the main supply passageway 60 and both the first and second conduits 44 and 46, and thereby permitting shifting of the transmission mechanism 18 by operation of the flow control means 48.

However, unlike the first embodiment, the transmission mechanism 18 includes two separate in-drive positions in addition to the neutral position. When in the first drive position (shown in solid lines in FIG. 4) the engine powers the propeller 16 for forward drive, and when in the second drive position (shown in phantom lines in FIG. 4), the engine powers the propeller 16 for reverse drive. As in the first embodiment, when the transmission mechanism 18 is in the neutral position (as shown in solid lines in FIG. 3), the engine is operatively disconnected from the propeller 16.

To operate the transmission mechanism 18 between the neutral position, the first drive position, and the second drive position, the shifting mechanism 10 includes a first cylinder 68 and a second cylinder 69, each having diametrically opposed first and second ends, respectively, 70 and 72 for the first cylinder 68, and 71 and 73 for the second cylinder 69. A first piston 74 and a second piston 75 are mounted for movement in the respective first and second cylinders 68 and 69. Each piston 74 and 75 has a first piston face 76 communicating with the respective first end 70 or 71 and a second piston face 77 communicating with the respective second end 72 or 73. A first connecting rod 78 is suitably fastened to the first face 76 of the first piston 74, thereby operatively connecting the first piston 74 with the transmission mechanism 18, and a second connecting rod 80 similarly operatively connects the second piston 75 with the transmission mechanism 18. As in the first embodiment, because of the passage of the first and second connecting rods 78 and 80 through the respective first ends 70 and 71, the effective area of the second piston face 77 of each piston 74 and 75 is larger than the effective area of the first piston face 76 of each piston 74 and 75.

As before described, the first conduit 44 continuously conducts pressurized fluid from the pressure head side 43 of the pump 40 to each of the first chambers 70 and 71, thereby locating the first piston 74 and the second piston 75 adjacent to their respective second ends 72 and 73. When both of the pistons 74 and 75 are so located (as is shown in solid lines in FIG. 3), the transmission mechanism 18 is disposed in the neutral position.

The second conduit 46 includes an upper section 83 and a lower section 85. The lower section 85 is split into two independent branches; namely, a first branch 82 which communicates adjacent to the second end 72 of the first cylinder 68 and a second branch 84 which communicates adjacent to the second end 73 of the second cylinder 69. The flow control means 48 is a shuttle valve 86 of conventional construction (not shown) and is selectively operative (as shown by the arrow in FIG. 3) between a venting position and two operating positions so as to control the disposition of either the first piston 74 or the second piston 75 in their respective cylinders 68 and 69.

More particularly, when the shuttle valve 86 is placed in the venting position (shown as position D in FIG. 3 and in phantom lines in FIG. 4), the upper section 83 of the second conduit 46 is blocked from communicating with either the first branch 82 or the second branch 84, and the first and second branches 82 and 84 are simultaneously vented to the sump 38 through suitable conduit means 88. Thus, no pressurized fluid passes to the second ends 72 and 73, and pressurized fluid existent in either second end 72 or 73 is permitted to escape to the sump 38. The transmission mechanism 18 is consequently disposed in the neutral position by the continuous flow of pressurized fluid through the first conduit 44, as has heretofore been described and is shown in solid lines in FIG. 3.

When the shuttle valve 86 is subsequently placed in the first operating position (shown as position E in FIG. 3 and in solid lines in FIG. 4), communication is afforded between the upper section 83 of the second conduit 46 and the first branch 82, while the second branch 84, and thus the second end 73 of the second cylinder 69, remain vented to the sump 38. As is shown in solid lines in FIG. 4, pressurized fluid is permitted to pass through the first branch 82 to thereby locate the first piston 74 adjacent to the first end 70 against the continuous action of pressurized fluid therein, while the second piston 75 remains located toward the second end 73 of the second cylinder 69. By virtue of moving the shuttle valve 86 from the venting position (position D in FIG. 3) to the first operating position (position E in FIG. 3), the transmission mechanism 18 has been shifted from the neutral position (shown in solid lines in FIG. 3) to the first or forward drive position (shown in solid lines in FIG. 4).

When the shuttle valve 86 is thereafter placed in the second operating position (shown as position F in FIG. 3 and in phantom lines in FIG. 4), communication is afforded between the upper section 83 of the second conduit 46 and the second branch 84, while the first branch 82 and the second end 72 of the first cylinder 68 are vented to the sump 38. As shown in phantom lines in FIG. 4, pressurized fluid is now permitted to pass through the second branch 84, and the second piston 75 is consequently located adjacent to the first end 71 against the action of pressurized fluid therein. Meanwhile, the continuous flow of pressurized fluid through the first conduit 44 urges the first piston 74 back toward the second end 72, as the pressurized fluid existent therein is vented to the sump 38. By virtue of moving the shuttle valve 86 from the first operating position (position E in FIG. 3) to the second operating position (position F in FIG. 3), the transmission mechanism 18 has been shifted from the first drive position (shown in solid lines in FIG. 4) to the second or reverse drive position (shown in phantom lines in FIG. 4).

It should now be apparent that whenever the shuttle valve 86 is moved between the first operating position (position E in FIG. 3) and the second operating position (position F in FIG. 3), as just described, or from either of the operating positions (positions E or F in FIG. 3) to the venting position (positions D in FIG. 3), the piston 74 or 75 which has heretofore been located adjacent to its respective first end 70 or 71 by the passage of pressurized fluid through the first branch 82 or the second branch 84 will be urged back adjacent to its respective second end 72 or 73 by the continuous flow of pressurized fluid through the first conduit 44 as soon as the respective branch 82 or 84, and thus the respective second end 72 or 73, are vented to the sump 38 by operation of the shuttle valve 86. Also, as it should be appreciated by virtue of the operation of the shuttle valve 86, it is not possible for both pistons 74 and 75 to be simultaneously located toward their respective first ends 70 and 71 at the same time.

The operation of the primary control valve 58 within the main supply passageway 60, as has heretofore been described in FIGS. 1 and 2 and as shown in FIG. 3, is not affected by the provisions of two independently operable pistons 74 and 75 as shown in FIGS. 3 and 4. As can be seen in FIG. 3, the placement of the first conduit 44, the upper section 83 of the second conduit 46, and the discharge passageway 62 relative to the main supply passageway 60 and relative to the movable member 64 is the same in FIG. 3 as it is in FIGS. 1 and 2. Thus, whenever pressurized fluid drops below the intermediate range of pressures (position A in FIG. 2), both pistons 74 and 75 are simultaneously located adjacent to the second ends 72 and 73 by the continuous flow of pressurized fluid through the first conduit 44, and subsequent operation of the shuttle valve 86 will be ineffective to shift the transmission mechanism 18 out of the neutral position into either the first or second drive positions. Similarly, should pressurized fluid rise above the intermediate range of pressures (position C in FIG. 2), the first conduit 44 and the second conduit 46, and thus the first branch 82 and the second branch 84, are all vented to the sump 38 through the discharge passage 62 to relieve the pressure in excess of the intermediate range of pressures to avoid damage to the shifting mechanism 18.

Various of the features of the invention are set forth in the following claims.

What is claimed is:

1. An apparatus for delivering power to a marine propulsion device which comprises an engine, a propeller, transmission means for operatively connecting said engine with said propeller, said transmission means being movable between a neutral position in which said engine is operatively disconnected from said propeller and a drive position in which said engine powers said propeller, a source of pressurized fluid, a cylinder having opposed first and second ends, a piston movable in said cylinder between said first end and said second end, said piston including a piston rod extending from said piston through said first end of said cylinder, first conduit means for conducting pressurized fluid from said source to adjacent to said first end to displace said piston toward said second end, second conduit means for conducting pressurized fluid from said source to adjacent to said second end to displace said piston toward said first end, said second conduit means including flow control means for selectively directing the flow of pressurized fluid to adjacent to said second end, and means connecting said piston rod with said transmission means for locating said transmission means in said neutral position when said piston is located adjacent to said second end and for locating said transmission means in said drive position when said piston is located adjacent to said first end.

2. An apparatus according to claim 1 wherein said source includes a sump, pump means having a suction side communicating with said sump and an oulet side communicating with said first and second conduit means and operative for pumping fluid from said sump through said first and second conduit means subject to a pressure varying between a low magnitude of pressure, a high magnitude of pressure, and an intermediate range of pressures between the low and high magnitudes of pressure.

3. An apparatus according to claim 2 wherein said second conduit means further includes flow regulation means independent of said flow control means for directing the flow of pressurized fluid through said second conduit means when the magnitude of pressure is within the intermediate range of pressures and for preventing the flow of pressurized fluid through said second conduit means when the low magnitude of pressure is present, notwithstanding the operation of said flow control means.

4. An apparatus according to claim 3 wherein said first and second conduit means include pressure relief means for relieving the high magnitude of pressure in excess of the intermediate range of pressures.

5. An apparatus according to claim 1 wherein said flow control means includes a control valve operative between a first position blocking the flow of pressurized fluid from said source to adjacent to said second end and a second position directing the flow of pressurized fluid from said source of adjacent to said second end.

6. An apparatus according to claim 4 and further including a main supply passageway having an inlet end communicating with said outlet side of said pump means, and a discharge passageway venting said main supply passageway to said sump subject to action of said pressure relief means, wherein said first and second conduit means communicate with said main supply passageway, and wherein said flow regulation means and said pressure relief means include a valve member movable in said main supply passageway between a first position directing the flow of pressurized fluid from said source through said first conduit means, a second position directing the flow of pressurized fluid from said source through said first conduit means and said second conduit means, and a third position for venting the flow of pressurized fluid from said source to said first and second chambers to said sump through said discharge passageway, and valve control means for disposing said valve member in said first position in response to the low magnitude of pressure in said main supply passageway, for disposing said valve member in said second position in response to the intermediate range of pressures in said main supply passageway, and for disposing said valve means in said third position in response to the high magnitude of pressure in said main supply passageway.

7. An apparatus according to claim 6 wherein said second conduit means communicates with said main supply passageway intermediate said inlet end and said discharge passageway, wherein said first conduit means communicates with said main supply passageway intermediate said inlet end and said valve member when said valve member is in said first position, and wherein said valve control means includes a biasing spring normally locating said valve member in said main supply passageway in a position closing said second conduit means and said discharge passageway from said main supply passageway, corresponding to said first position, said valve member being movable in response to the intermediate range of pressures against the action of said biasing spring to a position in said main supply passageway affording communication of said main supply passageway with said second conduit means, corresponding to said second position, said valve member being further movable in response to the high magnitude of pressure against the action of said biasing spring to a position in said main supply passageway affording communication of said supply passageway with said second conduit means and said discharge passageway, corresponding to said third position.

8. An apparatus according to claim 1 wherein said engine powers said propeller for forward drive when said transmission means is in said first mentioned drive position, wherein said transmission means further includes a second drive position in which said engine powers said propeller for reverse drive, wherein said apparatus further includes a second cylinder in addition to said first mentioned cylinder, said second cylinder including first and second ends, a second piston in addition to said first mentioned piston movable in said second cylinder between said first and second ends, said second piston including a second piston rod extending from said second piston through said first end of said second cylinder, wherein said first conduit means conducts pressurized fluid from said source to adjacent to each of said first ends to displace each of said first and second pistons toward said respective second ends, wherein said second conduit includes a first branch for conducting pressurized fluid from said source to adjacent to said second end of said first cylinder to displace said first piston toward said first end of said first cylinder, and a second branch for conducting pressurized fluid from said source to adjacent to said second end of said second cylinder to displace said second piston toward said first end of said second cylinder, wherein said flow control means communicates with said first and second branches for selectively permitting the flow of pressurized fluid to adjacent to either said second end of said first cylinder or said second end of said second cylinder, and wherein said apparatus further includes means connecting said first mentioned piston rod and said second piston rod with said transmission means for locating said transmission means in said neutral position when said first and second pistons are simultaneously located adjacent to said respective second ends, for locating said transmission means in said first mentioned drive position when said first piston is located adjacent to said first end and said second piston is located adjacent to said respective second end, and for locating said transmission means in said second drive position when said second piston is located adjacent to said respective first end and said first piston is located adjacent to said respective second end.

9. An apparatus according to claim 8 wherein said flow control means includes a control valve operative between a first position blocking the flow of pressurized fluid from said source to adjacent to said second ends of said first and second cylinders, a second position directing the flow of pressurized fluid from said source to adjacent to said second end of said first cylinder, and a third position directing the flow of pressurized fluid from said source to adjacent to said second end of said second cylinder.

10. An apparatus for delivering power to a marine propulsion device which comprises an engine, a propeller, transmission means for operatively connecting said engine with said propeller, said transmission means being movable between a neutral position in which said engine is operatively disconnected from said propeller and a drive position in which said engine powers said propeller, a sump containing a compressible fluid, a pump having a suction side communicating with said sump and a pressure head side for emitting fluid under pressure from said pump varying between a low magnitude of pressure, a high magnitude of pressure and an intermediate range of pressures between the low and high magnitudes of pressures, a cylinder having opposed first and second ends, a piston movable in said cylinder between said first and second ends and including a piston rod extending from said piston through said first end of said cylinder, a main supply passageway having an inlet end communicating with said pressure head side of said pump, a first conduit communicating with said main supply passageway for conducting pressurized fluid from said main supply passageway to adjacent to said first end to displace said piston toward said second end, a second conduit communicating with said main supply passageway for conducting pressurized fluid from said main supply passageway to adjacent to said second end to displace said piston toward said first end, said second conduit including a flow control valve operative between a first position blocking the flow of pressurized fluid from said main supply passageway to adjacent to said second end and a second position directing the flow of pressurized fluid from said main supply passageway to adjacent to said second end, a discharge passageway communicating with said main supply passageway and said sump, a primary control valve member displacable in said main supply passageway between a first position affording communication of said main supply passageway with said first conduit while closing said second conduit and said discharge passageway from said main supply passageway, a second position affording communication of said main supply passageway with said first conduit and said second conduit while closing said discharge passageway from said main supply passageway, and a third position affording communication of said main supply passageway with said first conduit, said second conduit and said discharge passageway, a biasing spring operatively connected with said primary control valve member and normally biasing said primary control valve member in said first position when the low magnitude of pressure is present in said main supply passageway, said primary control valve member being movable in response to the intermediate range of pressures against the action of said biasing spring from said first position to said second position, said primary control valve being further movable in response to the high magnitude of pressure against the action of said biasing spring from said second position to said third position, and means connecting said piston rod with said transmission means for locating said transmission means in said neutral position when said piston is located adjacent to said second end and for locating said transmission means in said drive position when said piston is located adjacent to said first end.

11. An apparatus according to claim 10 wherein said engine powers said propeller for forward drive when said transmission means is in said first mentioned drive position, wherein said transmission means further includes a second drive position in which said engine powers said propeller for reverse drive, wherein said apparatus further includes a second cylinder addition to said first mentioned cylinder, said second cylinder including first and second ends, a second piston in addition to said first mentioned piston and movable in said second cylinder between said first and second ends, said second piston including a second piston rod extending from said second piston through said first end of said second cylinder, wherein said first conduit conducts pressurized fluid from said main supply passageway to adjacent to each of said first ends to displace each of said first and second pistons toward said respective second ends, wherein said second conduit includes a first branch for conducting pressurized fluid from said main supply passageway to adjacent to said second end of said first cylinder to displace said first piston toward said first end of said first cylinder, and a second branch for conducting pressurized fluid from said main supply passageway to adjacent to said second end of said second cylinder to displace said second piston toward said first end of said second cylinder, wherein said flow control valve communicates with said first branch and said second branch and is operative between a first position blocking the flow of pressurized fluid from said main supply passageway through said first and second branches, a second position directing the flow of pressurized fluid from said main supply passageway through said first branch, and a third position directing the flow of pressurized fluid from said main supply passageway through said second branch, and wherein said apparatus further includes means connecting said first mentioned piston rod and said second piston rod with said transmission means for locating said transmission means in said neutral position when said first and second pistons are simultaneously located adjacent to said respective second ends, for locating said transmission means in said first mentioned drive position when said first piston is located adjacent to said respective first end and said second piston is located adjacent to said respective second end, and for locating said transmission means in said second drive position when said second piston is located adjacent to said respective first end, and said first piston is located adjacent to said respective second end.

* * * * *